US005275041A

United States Patent [19]

Poulsen

[11] Patent Number: 5,275,041

[45] Date of Patent: Jan. 4, 1994

[54] EQUILIBRIUM FRACTURE TEST AND ANALYSIS

[75] Inventor: Don K. Poulsen, Duncan, Okla.

[73] Assignee: Halliburton Company, Duncan, Okla.

[21] Appl. No.: 944,142

[22] Filed: Sep. 11, 1992

[51] Int. Cl.[5] ..... E21B 47/00

[52] U.S. Cl. ..... 73/155; 166/308

[58] Field of Search ..... 73/155, 151; 166/250, 166/308

[56] References Cited

U.S. PATENT DOCUMENTS

| | | | |
|---|---|---|---|
| 4,372,380 | 2/1983 | Smith et al. | 166/250 |
| 4,398,416 | 8/1983 | Nolte | 73/155 |
| 4,836,284 | 6/1989 | Tinker | 166/279 |
| 4,848,461 | 7/1989 | Lee | 166/250 |
| 5,005,643 | 4/1991 | Soliman et al. | 166/250 |
| 5,050,674 | 9/1991 | Soliman et al. | 166/250 |

OTHER PUBLICATIONS

Paper (SPE 18883) entitled "Equilibrium Acid Fracturing: A New Fracture Acidizing Technique For Carbonate Formations," presented on Mar. 13-14 at the 1989 SPE Production Operations Symposium.

*Primary Examiner*—Robert J. Warden
*Assistant Examiner*—Krisanne M. Thornton
*Attorney, Agent, or Firm*—Robert A. Kent

[57] ABSTRACT

The present invention is generally directed to a method for determining certain parameters necessary for fracture treatment design. The method and analysis of the present invention provide for calculation of the product of the fluid-loss coefficient and the fracture half length or the square of fracture radius. The test disclosed in this invention does not generally require the assumption of a fracture geometry and does not require the assumption of a fracture height. The information gained from performing this test may be used to properly design fracture treatments for any given well. In addition, the method of the present invention may be used in conjunction with the methods currently known in the art to provide more information than any of the methods individually.

14 Claims, 4 Drawing Sheets

RADIAL TYPE CURVES FOR n=0.25

RADIAL TYPE CURVES FOR n=0.5

RADIAL TYPE CURVES FOR n=0.75

RADIAL TYPE CURVES FOR n=1.0

EQUILIBRIUM FRACTURE TEST AND ANALYSIS

BACKGROUND OF THE INVENTION

The present invention relates generally to a method for determining parameters which are to be used in designing a hydraulic fracturing treatment of an underground formation.

Methods of calculating certain parameters used in fracture treatment designs have been used through the years either to check assumptions made during design or to measure parameters to be used in design. One method commonly used to gather such information is the pump-in, shut-in mini-frac test where fluid is injected at a constant rate for a set period of time and then injection is immediately shut in. The downhole pressures are measured during the shut-in period and then are used to determine various parameters.

While these pump-in, shut-in tests have proved valuable in the past, they suffer from several shortcomings including (1) the analysis is dependent on accurate knowledge of rock properties, (2) the analysis is often dependent on accurate knowledge of fluid flow properties, (3) the pressure drop acting as a driving force for fluid loss changes with time, (4) the analysis require the assumption of a fracture height, and (5) the analysis is greatly dependent on the selection of a fracture width equation. The most critical of these shortcomings is the need to assume the applicability of a particular fracture width equation.

None of the current methods, i.e., Nolte, U.S. Pat. No. 4,398,416, and Lee, U.S. Pat. No. 4,848,461, eliminate the need for either knowledge of, or an assumption of, formation data, including the plane-strain modulus, E'. Current methods are heavily dependent on the three fracture geometry models widely known in the industry. In addition, any one of the current methods requires the assumption of a fracture height. While, when using one of the current methods, the fluid-loss exponent may be determined by methods introduced in U.S. Pat. No. 5,005,643 "Method of Determining Fracture Parameters for Heterogeneous Formations" by Mohamed Y. Soliman et al., those methods still suffer from the need for knowledge of, or assumptions of, formation data. As a result, because of the assumptions made in the known methods the actual fracture design starts with a potential for error.

SUMMARY OF THE INVENTION

The present invention is generally directed to a method for determining certain parameters necessary for fracture treatment design. The method of the present invention does not generally require the assumption of a particular fracture geometry and does not require the assumption of a fracture height. The method of the present invention comprises injecting a fluid which is intended to be used in the main fracturing treatment into the formation, preferably at a constant rate, so as to create a fracture. While a constant rate is preferable, any generally constant variation rate such as a linearly increasing rate may be used. Once a fracture of substantial length or radius has been created, the operator decreases the injection rate so as to drop the bottom-hole treating pressure to a value below the fracture extension pressure but above the fracture closure pressure, thereby ceasing fracture growth but not allowing the fracture to close. A fracture of substantial length is one where a fracture growth trend is established or, if the fracture is not contained within the permeable height, at least one where the fracture half length is greater than the permeable height. A fracture of substantial radius is one where it can be determined that the fracture is growing radially.

At this point, the operator will gradually reduce the injection rate so as to maintain a bottom-hole treating pressure as constant as possible, however slightly below fracture extension pressure. This should maintain a constant fracture length, or radius, and width and in so doing, the injection rate should equal the fluid-loss rate from the fracture. The injection rate is accurately monitored during this step to provide data for further analysis in accordance with the present invention. After a substantial period of constant pressure, the test is concluded. The test is preferably performed for a sufficient time to get late time data providing a stabilized slope on a log injection rate versus log dimensionless time graph to give more accurate values in the test to follow. If the test cannot be performed for a time necessary to gather late time data, a more difficult type-curve matching and verification process will have to be performed. For further follow-up data, the well may be immediately shut-in for a pump-in, shut-in analysis using one of the current methods or the well may be immediately flowed back at a constant rate for a pump-in, flow-back analysis. These two methods provide estimates of the fluid-loss coefficient and fracture length which may be compared to the values determined using the present invention. Therefore, the use of current methods will provide yet another check point to ensure that the operator is getting accurate parameters to be used in fracture design.

In accordance with the present invention, the data obtained during the equilibrium fracture test will be used to determine a fluid-loss exponent, an exponent relating the rate of fracture length or radius growth to time, and a number which represents the product of the fluid-loss coefficient and fracture half length or square of the fracture radius. Particularly, the present invention will provide the product of the fluid-loss coefficient and the fracture half length or the square of the fracture radius.

Equations are presented below for two basic cases, although, as will be understood by those skilled in the art, additional functional relationships and equations may be generated for additional, different cases. dr

DESCRIPTION OF THE PRESENT INVENTION

Figure 1:
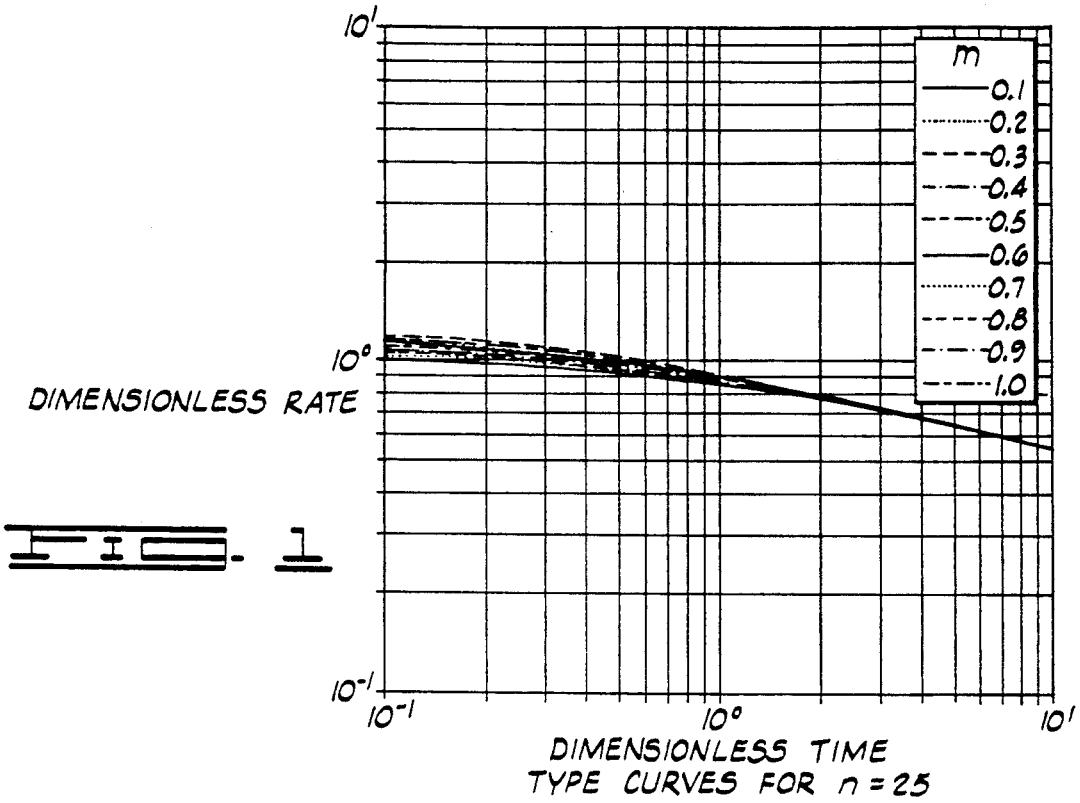
FIGS. 1–8 are all type-curves for use in the calculations discussed in this section. The figures will be discussed more fully below in the context of their use in calculations.

To perform the present invention to determine parameters of a full-scale fracture treatment, the following steps are used. The operator injects fluid that will be used in the full scale fracture treatment into the subterranean formation. The injection rate preferably will be constant, but may be at a generally constant variation rate such as a linearly increasing rate. In addition, the injection rate and pressure should be sufficient to create a fracture. After a fracture of substantial length or radius is created, the injection rate should be reduced so that the bottom-hole treating pressure is below the fracture extension pressure and above the fracture closure pressure. At this point, the injection rate should be gradually reduced so as to maintain the bottom-hole treating pressure between the fracture closure and extension pressures. During the period of gradual injection rate reduction the injection rate data should be monitored/gathered versus the time of injection (both from the start of injection and from the start of the gradual reduction period). This procedure of monitoring should be continued until the plot of the log of the rate of injection ($q_i$) versus the log of dimensionless time stabilizes to a relatively constant slope, i.e., until late time data are gathered. The stabilized slope may then be used to determine the fluid-loss exponent. If no late time data are gathered, a more difficult type-curve matching and verification process will be used to determine the fluid-loss exponent. The fluid-loss exponent then may be used as described below to determine the fracture growth exponent and subsequently the product of the fluid-loss coefficient and the fracture half length or the square of fracture radius at the end of the period of constant or constant variation injection. Finally, the product may be used to solve for the fluid-loss coefficient which is a necessary parameter for standard modeling techniques for full-scale fracture design.

Case 1: Constant Permeable Height Fracture

This case assumes that the fracture growth direction is approximately linear along the permeable formation. Thus, this case is particularly applicable to confined, constant height fractures, but may also be readily applied to any fracture, including radial, where the maximum fracture height has exceeded the permeable height for a large part of the job so that growth along the formation may be approximated as linear.

Underlying Calculations

If, by adjusting injection rate, the fluid in a fracture is held at a constant pressure below fracture extension pressure and above fracture closure pressure, then fracture area, width, and thus volume, should remain constant and thus the rate of injection ($q_i$) should equal the rate of fluid-loss ($q_{fl}$).

$$q_i = q_{fl} \qquad \text{Equation 1}$$

For the four faces present in the two wings of the fracture, the total fluid-loss rate can be characterized according to the relationship:

$$q_{fl} = 4\,CH_n \int_o^{L_o} \frac{dx}{(\Delta t(x))^n} \qquad \text{Equation 2}$$

where:

C is the effective fluid-loss coefficient;

$H_n$ is the net permeable height within the fracture;

$L_o$ is the fracture half length at the end of constant rate injection period described above;

x is linear distance from the wellbore;

$\Delta t$ is the fluid-formation contact time; and n is the fluid-loss exponent.

Since it can be assumed that fracture length growth during the period of constant rate or constant variation rate injection can be characterized by a power-law relationship, then $$L = L_o\left(\frac{t}{t_o}\right)^m \qquad \text{Equation 3}$$

where:

L is the fracture half length at time t, m is the fracture length growth exponent, t is the elapsed time since beginning of injection but less than or equal to $t_o$, and $t_o$ is the elapsed time of injection at the end of the constant rate or constant variation rate time period.

Therefore, the time at which the fracture reached any point x was $$\tau(x) = t_o\left(\frac{x}{L_o}\right)^{1/m} \qquad \text{Equation 4}$$

where $\tau(x)$ is the time at which the fracture reached a length x. Because the fluid-formation contact time, $\Delta t$, at any point is the difference between the total time, t, and the time at which the fracture reached the point, $\tau$, $\Delta t(x)$ may be solved for as follows:

$$\Delta t(x) = t - \tau(x) = t_o\left(\frac{t}{t_o} - \left(\frac{x}{L_o}\right)^{1/m}\right) = t_o(1 + \delta - \lambda^{1/m}) \qquad \text{Equation 5}$$

where $\delta = (t - t_o)/t_0$ and $\lambda = x/L_o$.

Substituting Equation (5) into Equation (2) and combining with Equation (1) gives:

$$\begin{aligned} q_i &= 4\,CH_n \int_o^{L_o} \frac{dx}{t_o^n(1 + \delta - \lambda^{1/m})^n} \\ &= 4\frac{CH_nL_o}{t_o^n} \int_o^1 \frac{d\lambda}{(1 + \delta - \lambda^{1/m})^n} \\ &= \frac{4\,CH_nL_o}{t_o^n} f(\delta) \end{aligned} \qquad \text{Equation 6}$$

where the dimensionless rate function, f, is given by:

$$f(\delta) = \int_o^1 \frac{d\lambda}{(1 + \delta - \lambda^{1/m})^n} \qquad \text{Equation 7}$$

Solving for the Necessary Parameters

Using the injection rate and time data gathered during the period where injection rate is gradually reduced so as to maintain a constant bottom-hole treating pressure, as described above, a graph is prepared of the log of $q_i$ versus log of dimensionless time, $\delta$, or $(t - t_o)/t_o$. This graph is used in the following calculations.

Figure 2:
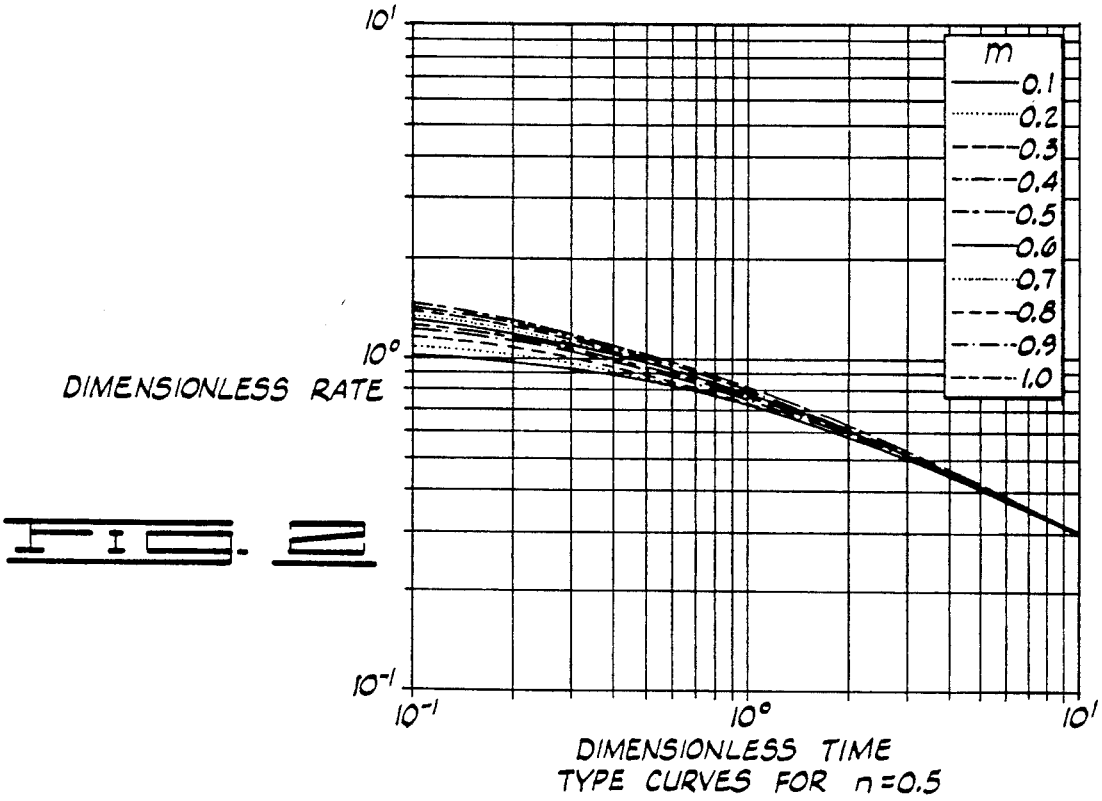
Figure 3:
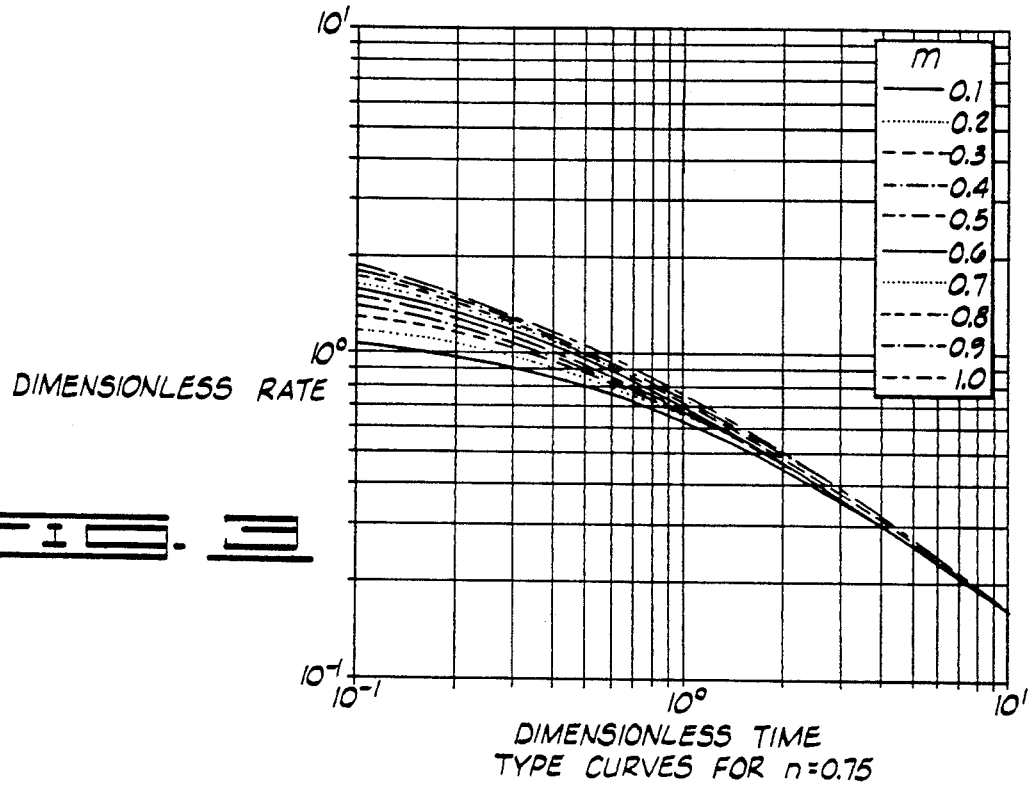
Figure 4:
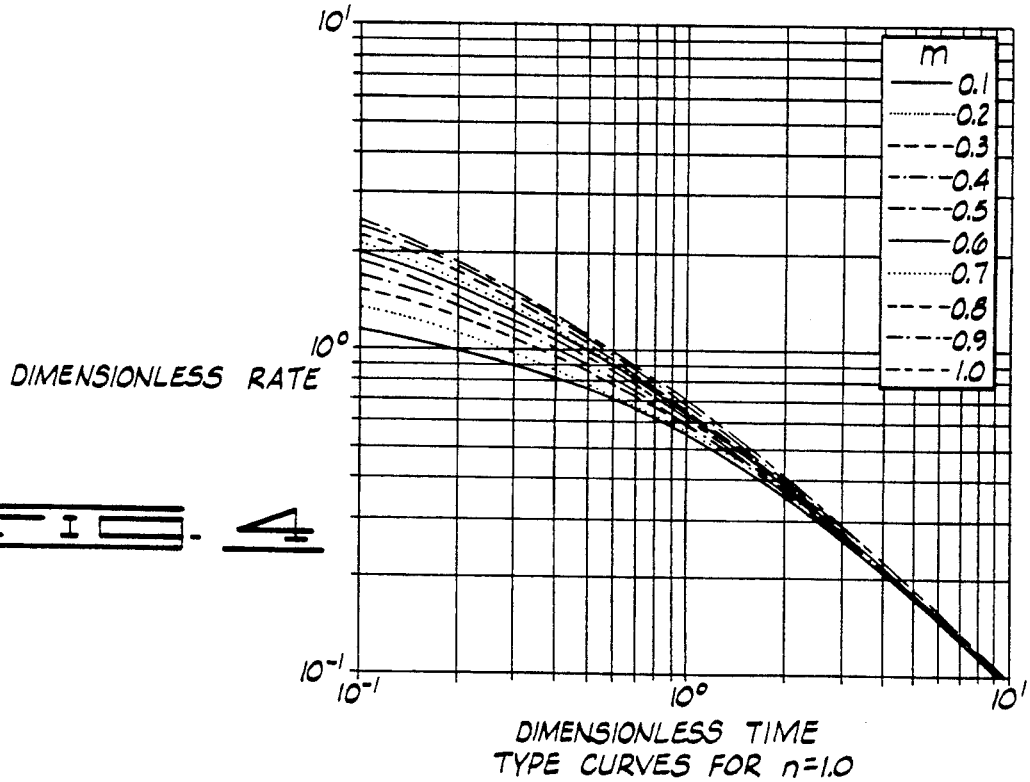

FIGS. 1–4 present type-curves described by Equations (6) and (7). They are plotted as log of dimensionless rate function versus log of dimensionless time, but could have been presented in another usable form as log of dimensionless rate function versus dimensionless time. The graphs presented are for fluid-loss exponents, n, of 0.25, 0.5. 0.75, and 1. For n=0 the type-curves will be horizontal lines at f=1. Each type-curve on a graph represents a different value of the fracture growth exponent, m. Obviously, type-curves and graphs for other exponents could be generated in addition.

Having two values, n and m, to determine could potentially make the type-curve matching process difficult. Fortunately, as is demonstrated below, when log (f) is plotted versus log (δ) the late time slope approaches −n. Therefore, if the test is sufficiently long one need only determine the late time slope of log ($q_i$) versus log (δ).

The long-term slope on the log—log graph of dimensionless rate versus dimensionless time may be obtained by taking the limit, as δ approaches infinity, of the derivative of ln(f) with respect to ln(δ), as is shown below.

$$\lim_{\delta\to\infty}\frac{d(\ln f)}{d(\ln\delta)} = \lim_{\delta\to\infty}\frac{\delta}{f}\,\frac{df}{d\delta} \qquad \text{Equation 8}$$

$$= \lim_{\delta\to\infty}\frac{\delta\frac{d}{d\delta}\left[\int_0^1\frac{d\lambda}{(1+\delta-\lambda^{1/m})^n}\right]}{\int_0^1\frac{d\lambda}{(1+\delta-\lambda^{1/m})^n}}$$

$$= \lim_{\delta\to\infty}\frac{\delta\int_0^1\frac{-n\,d\lambda}{(1+\delta-\lambda^{1/m})^{n+1}}}{\int_0^1\frac{d\lambda}{(1+\delta-\lambda^{1/m})^n}}$$

$$= -n\frac{\int_0^1\frac{d\lambda}{\delta^n}}{\int_0^1\frac{d\lambda}{\delta^n}}$$

$$= -n$$

The finding that for large values of δ the slope of the log (f)−log (δ) graph will be −n holds for both radial and limited permeable height cases.

So, as stated above, one method of determining n is to determine the late time slope of log ($q_i$) versus log (δ).

Another method of determining n would be to plot $-d(\ln(q_i))/d(\ln(\delta))$ $(=-\delta/q_i\,dq_i/d\delta)$ versus δ or versus log (δ). The resulting curve should asymptotically approach the value of n.

The two methods just discussed of determining n, the fluid-loss exponent, both require late time data to get an accurate determination of n. Late time data are those data which provide stabilized slope on the graph of log of injection rate versus log of dimensionless time. If late time data are not available, and type-curve matching alone must be used, whatever match is made can be verified by one of the following three approaches.

First, is to plot log ($q_i$) versus log (f) for the period when the injection rate is being gradually reduced. If the proper match has been made the result will be a line with a slope of one and an intercept (at f=1) of log ($q^*$), where $q^*$ is defined as the rate corresponding to a dimensionless rate of 1.

A second verification method is to plot $q_i$ versus f. With an exact match, a straight line through the origin with a slope $q^*$ will be received.

The third and preferred procedure is to plot $q_i/q^*$ versus f. An exact match will give a straight line through the origin with a slope of 1. However, it should be recognized that an exact match will seldomly occur in either procedure.

Finally, in most fracture treatments n may be assumed to be ½. While this obviously introduces some error into the final calculations, in most applications the error is minimal.

Figure 5:
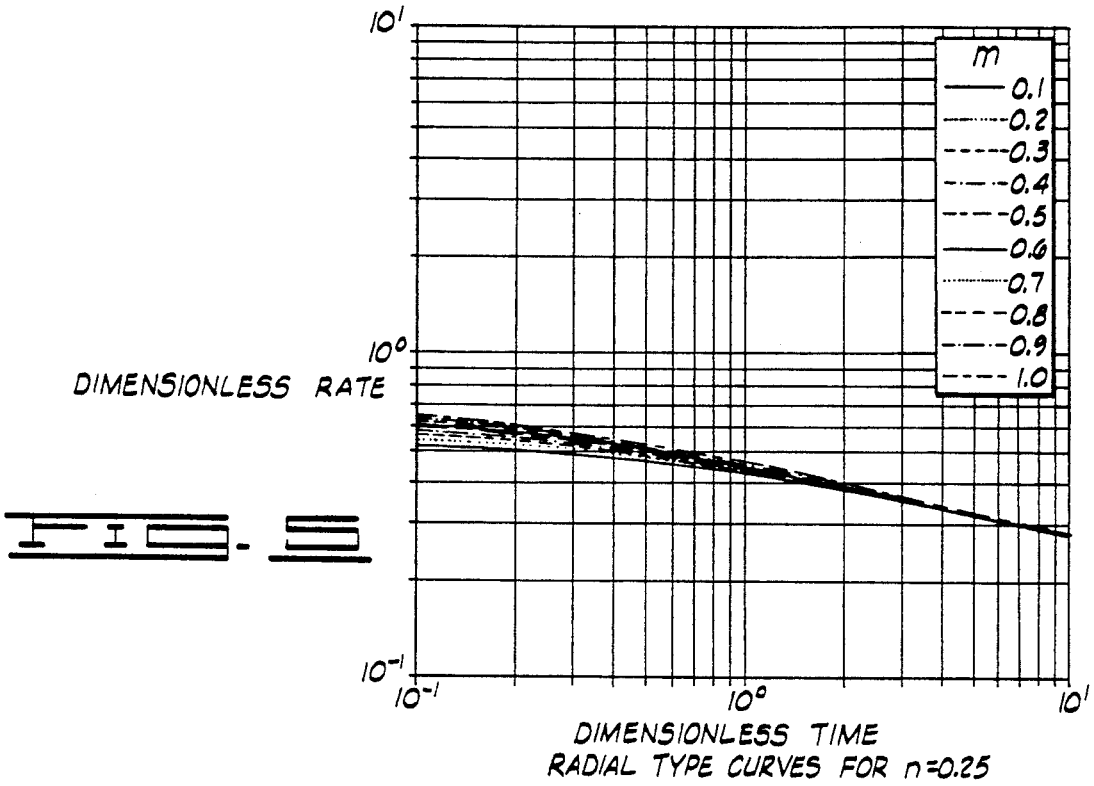
Figure 6:
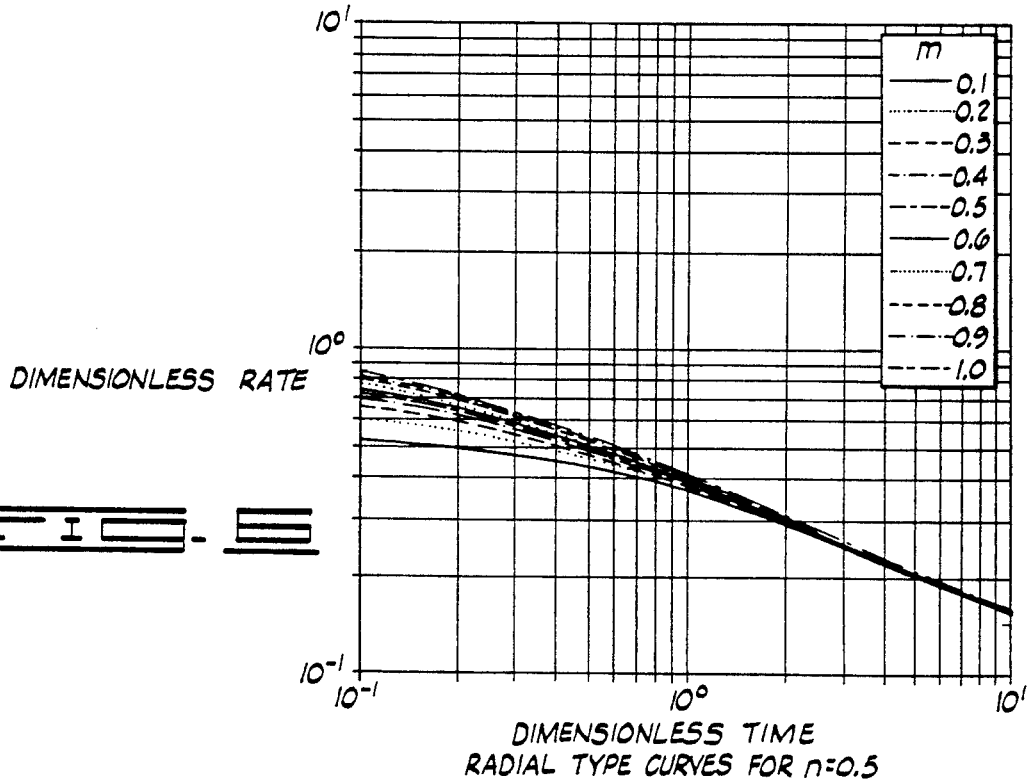
Figure 7:
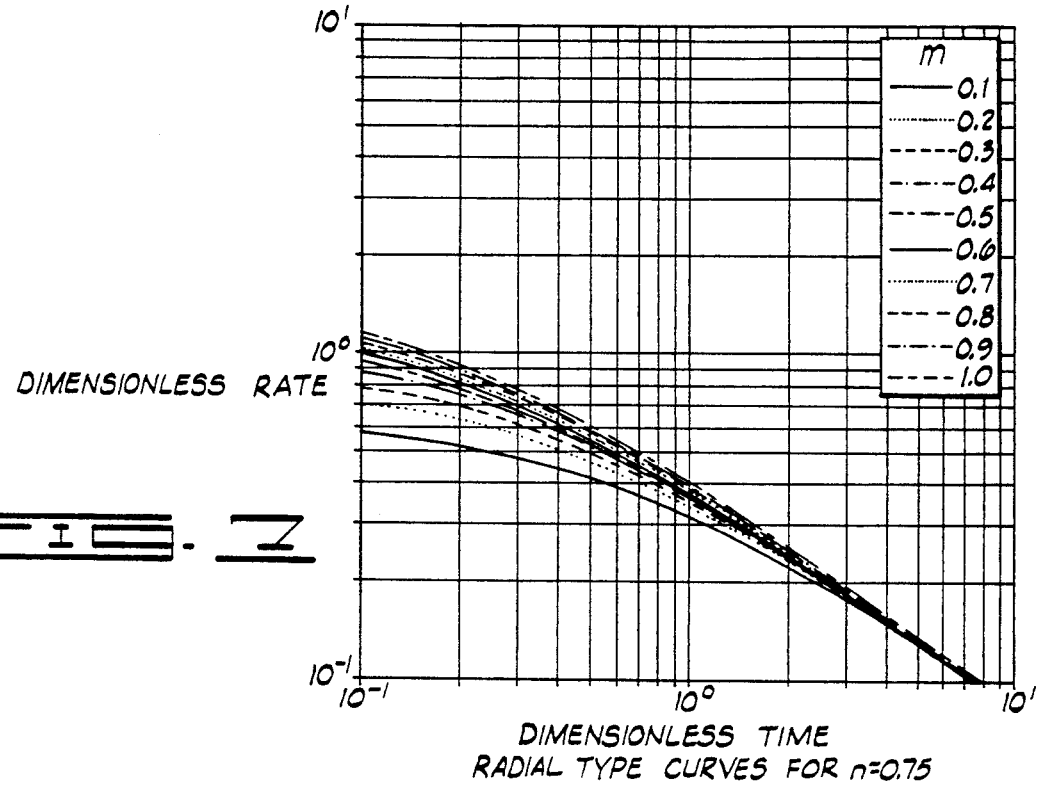
Figure 8:
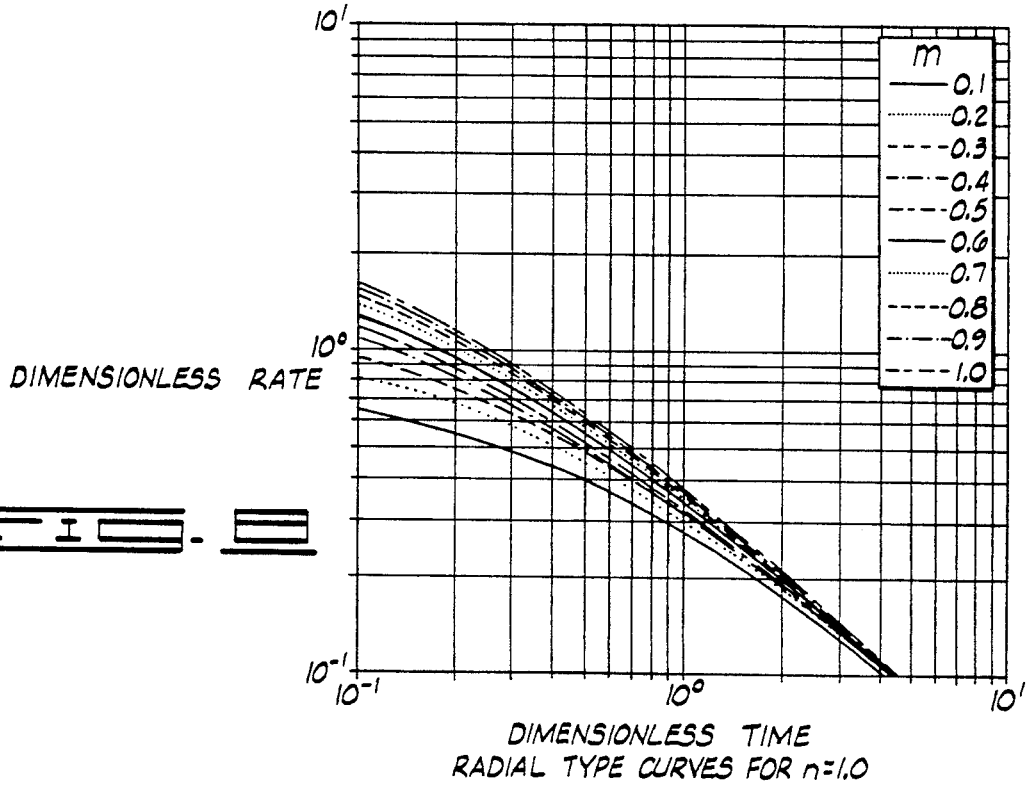

Once n is determined, the graph or set of type-curves (FIGS. 1-8) associated with the particular value of n is selected and the curve of collected data showing log of injection rate $q_i$ versus log of dimensionless time discussed above may be matched to a type-curve which corresponds to the value of the fracture length growth exponent, m. By matching log of injection rate versus log of dimensionless time to the proper curve, $q^*$, the rate corresponding to a dimensionless rate of 1, can be determined. From $q^*$ and Equation (6), defining $q^*$ as the rate corresponding to $f(\delta)=1$, the product of fluid-loss coefficient and fracture half length at the end of the constant rate injection may be determined as follows $$CL_o = \frac{q^*\,t_o^n}{4\,H_n} \qquad \text{Equation 9}$$

The product of the fluid-loss coefficient and fracture half length at the end of the period of constant rate or constant variation rate injection so determined is then adjusted from the fracture formation pressure drop of the test to that of the subsequent fracturing treatment.

Rather than using type-curve matching, the fracture length growth exponent, m, may be assumed; however, this procedure is not recommended.

For a constant injection rate and negligible fluid-loss, $$m \approx \begin{bmatrix} \frac{n'+1}{n'+2}\ (KZ\text{-type}) \\ \frac{2(n'+1)}{2n'+3}\ (PK\text{-type}) \\ \frac{2(n'+1)}{3(n'+2)}\ (\text{radial}) \end{bmatrix}$$

where n' is the power-law flow behavior index of the fracturing fluid, KZ-type is a Khristianovic & Zheltov fracture growth model, PK-type is a Perkins & Kern fracture growth model, and radial is a radial fracture.

For a constant injection rate and high fluid-loss, $$m \approx \begin{bmatrix} \frac{1}{2}\ (KZ\text{-type}) \\ \frac{1}{2}\ (PK\text{-type}) \\ \frac{1}{4}\ (\text{radial}) \end{bmatrix}$$

The above assumptions in essence act as bounding values. However, because generally the present invention does not assume a fracture growth model, these assumptions may not strictly hold. It is preferred to perform type-curve matching to determine m.

In a preferred implementation, the fracturing operation parameters will be determined mathematically, through use of an appropriately programmed computer, rather than through the physical procedure of type-curve matching.

Case 2: Radial Fracture in a Uniform Formation

While the following equations and corresponding type-curves were prepared for either horizontal or vertical radial fractures, they could also extend to elliptical or other shaped fractures contained in a single zone.

Underlying Calculations

For a radial fracture with its entire area open to fluid loss, the total fluid-loss rate can be characterized according to the relationship:

$$q_{fl} = \int_o^{R_o} \frac{C}{(\Delta t(r))^n} 4\pi r dr = 4\pi C \int_o^{R_o} \frac{r dr}{(\Delta t(r))^n} \quad \text{Equation 10}$$

where:

r is the radial distance from point of fracture initiation, and $R_o$ is the fracture radius at the end of constant rate injection; all other values are defined as in case 1.

The fracture radius growth during the period of constant rate injection can be characterized by a power-law relationship, $$R = R_o\left(\frac{t}{t_o}\right)^m \quad \text{Equation 11}$$

where R is the fracture radius at time t. The time at which the fracture reached any radius r was $$\tau(r) = t_o\left(\frac{r}{R_o}\right)^{1/m} \quad \text{Equation 12}$$

and $$\Delta t(r) = t - \tau(r) = t_o(1 + \delta - \lambda^{1/m}) \quad \text{Equation 13}$$

where $\delta = (t - t_o)/t_o$ and $\lambda = r/R_o$

Substituting Equation (13) into Equation (10) and combining with Equation (1) gives $$\begin{aligned} q_i &= 4\pi C \int_o^{R_o} r \frac{dr}{t_o^n(1 + \delta - \lambda^{1/m})^n} \\ &= \frac{4\pi C R_o^2}{t_o^n} \int_o^1 \frac{\lambda d\lambda}{(1 + \delta - \lambda^{1/m})^n} \\ &= \frac{4\pi C R_o^2}{t_o^n} f(\delta) \end{aligned} \quad \text{Equation 14}$$

$$\text{where } f(\delta) = \int_o^1 \frac{\lambda d\lambda}{(1 + \delta - \lambda^{1/m})^n} \quad \text{Equation 15}$$

By defining a match rate, q*, as the rate corresponding to $f(\delta) = 1$, Equation (14) solves to $$CR_o^2 = \frac{q^* t_o^n}{4\pi} \quad \text{Equation 16}$$

FIGS. 5-8 present graphs or sets of type-curves described by Equations (14) and (15) for values of n at 0.25, 0.5, 0.75, and 1. For n=0 the type-curves will be horizontal lines at f=0.5.

As in Case 1, the different curves relate to different values of m. The methods of determining and verifying n as described in Case 1 apply equally here. After applying one of the previously discussed methods of determining n the set of type-curves corresponding to the determined value of n should be used to do curve matching. In addition, the assumption for m may be made here; however, it is not recommended.

Curve matching of log of injection rate, $q_i$, versus log of dimensionless time, during the period where injection rate is gradually reduced, can be used to determine a match rate of q*. The product of fluid-loss coefficient and the square of fracture radius may then be obtained using q* as shown in Equation 16.

Again, as in Case 1, the product of fluid-loss coefficient and the square of fracture radius at the end of constant rate injection should be subsequently adjusted for pressure drop.

Once again, in a preferred implementation, the fracturing operating parameters will be determined mathematically, through use of an appropriately programmed computer, rather than through the physical procedure of type-curve matching.

Other Cases

It would be possible to generate type-curves for other cases, such as when a radial fracture broke out of the permeable zone, but not far enough for the linear fracture growth curves to be valid. However, for the most part this would be impractical since a very large array of graphs would be required for the multitude of possible intermediate situations. The two varieties of type-curves presented here should suffice for a large majority of cases.

Pump-In. Shut-In Analysis

As mentioned above, a shut-in period may follow the equilibrium fracture test and with proper adjustment may be analyzed using typical mini-frac analysis methods. The available analyses for pump-in, shut-in tests assume that until shut-in, fluid has been injected at a constant rate. This is obviously not the case if an equilibrium test is conducted just prior to shut-in. However, it is easily shown that by substituting the dimensionless time value δ defined herein for the dimensionless time used in conventional pump-in, shut-in analysis, a conventional pump-in, shut-in analysis may be used. The effect will be that there will be no early time data on the curves so all matching will have to be done using the later portion of the type-curves.

Application of Results

The operator must be aware in using the results of the tests described herein that the result of the equilibrium fracture test analysis is the product of the fluid-loss coefficient and either fracture half length or the square of the fracture radius, not the fluid-loss coefficient alone. Therefore, varying methods may be used for applying the results of the tests. First, the operator may calculate the fluid-loss coefficient from an available theory such as is presented in SPE Paper No. 18262 authored by Don K. Poulsen, entitled "A Comprehensive Theoretical Treatment Of Fracturing Fluid-loss." From the calculated overall fluid-loss coefficient value and its product with half length or square of the radius, the operator can determine the fracture half length or radius. Using a fracture design model for a constant permeable height fracture and the theoretical fluid-loss coefficient value, through trial and error, it may be determined which effective fracture height will give the calculated length for the volume pumped during the period of constant injection rate. Another method is to run a fracture design model with various values of the fluid-loss coefficient until the product of the fluid-loss coefficient and the half length or the square of the radius from the model corresponds to the value obtained using the equilibrium fracture test and analysis. If a 2D constant height model is used, this method assumes that (1) the selected model is correct and (2) the assumed fracture height is correct. Another method is to perform a pump-in, shut-in analysis for different geometries and determine which agrees more closely with the equilibrium test analysis.

The preferred method is to perform a pump-in, shut-in analysis and through trial and error vary the assumed height in the pump-in, shut-in analysis until the fluid-loss coefficient and the fracture length or radius values of the pump-in, shut-in analysis agree with the product of the two from the equilibrium test analysis. This will give more reliable values for fluid-loss coefficient, length or radius of fracture, and the fracture height.

Therefore, the operator may use the product determined through the present method to solve for the fluid-loss coefficient which in turn may be used to more accurately design full scale fracture treatment using well known modeling techniques.

As can be seen from the above discussion, the disclosed invention has many advantages over prior methods of determining fracture parameters. The disclosed test is independent of fracture mechanics. Therefore, the analysis requires no knowledge of the rock properties or of fluid mechanics. Generally, the test is independent of fracture growth behavior and it is therefore unnecessary to know what fracture width equation, if any, best applies. Nor is it necessary to have any knowledge of fracture height. The test allows the fluid-loss exponent, n, to be determined directly and also provides for determining the fracture length-growth exponent, m. Finally, the test may be performed in conjunction with a pump-in, shut-in or a pump-in, flow-back test. Doing so will greatly increase the information, accuracy, and value over what would be available from either of the individual tests alone.

What is claimed is:

1. A method of determining parameters of a full scale fracture treatment of a subterranean formation comprising the steps of:

a) injecting fluid that will be used in said full scale fracture treatment into said subterranean formation at a generally constant rate or a lineraly increasing rate sufficient to create a fracture having a length and a permeable height;

b) decreasing said injection rate, after a fracture of substantial length has been created, such that the bottom-hole treating pressure is below a predetermined fracture extension pressure and above a predetermined fracture closure pressure;

c) gradually reducing said injection rate so as to maintain said bottom-hole treating pressure approximately constant, but above said fracture closure pressure and below said fracture extension pressure;

d) monitoring said injection rate during the step disclosed in paragraph (c);

e) continuing said step of gradual reduction in said injection rate until a period of approximately constant bottom-hole treating pressure has been achieved;

f) determining at least one parameter needed for a fracture treatment design from said injection rate during said step of gradual reduction in said injection rate;

g) using said parameter to solve for the product of the fluid-loss coefficient and fracture half length; and h) using said product of fluid-loss coefficient and fracture half length to determine parameters of said full-scale fracture treatment.

2. The method of claim 1 wherein said fracture of substantial length is a fracture with a fracture length of at least twice the permeable height of the zone being treated.

3. A method of determining parameters of a full scale fracture treatment of a subterranean formation comprising the steps of:

a) injecting fluid that will be used in said full scale fracture treatment into said subterranean formation through a wellbore at a generally constant rate or a lineraly increasing rate sufficient to create a fracture having a length and a permeable height;

b) decreasing said injection rate, after a fracture of substantial length has been created, such that the bottom-hole treating pressure is below a predetermined fracture extension pressure and above a predetermined fracture closure pressure;

c) gradually reducing said injection rate so as to maintain said bottom-hole treating pressure approximately constant, but above said fracture closure pressure and below said fracture extension pressure;

d) monitoring said injection rate during the step disclosed in paragraph (c);

e) continuing said step of gradual reduction in injection rate until a period of approximately constant bottom-hole treating pressure has been achieved;

f) plotting log of said injection rate versus log of dimensionless time;

g) determining the fluid-loss exponent;

h) determining the fracture growth exponent;

i) calculating the product of the fluid-loss coefficient and the fracture half length at the end of said period of constant or linearly increasing injection rate; and j) using said product to design said full scale fracture treatment.

4. The method of claim 3 wherein said fracture of substantial length is a fracture with a fracture length of at least twice the permeable height of the zone being treated.

5. The method of claim 3 further comprising a step, performed after said period of approximately constant bottom-hole treating pressure is achieved, of shutting-in the wellbore and performing a pump-in, shut-in analysis.

6. The method of claim 3 further comprising a step, performed after said period of approximately constant bottom-hole treating pressure is achieved, of flowing-back the injected fluid through the wellbore and performing a pump-in, flow-back analysis.

7. The method of claim 1 wherein said initial fluid injection is at a generally constant rate.

8. The method of claim 3 wherein said initial fluid injection is at a generally constant rate.

9. A method of determining parameters of a full scale fracture treatment of a subterranean formation comprising the steps of:

a) injecting fluid that will be used in said full scale fracture treatment into said subterranean formation at a generally constant rate or a lineraly increasing rate sufficient to create a fracture;

b) decreasing said injection rate, after a fracture of substantial radius has been created, such that the bottom-hole treating pressure is below a predetermined fracture extension pressure and above a predetermined fracture closure pressure;

c) gradually reducing said injection rate so as to maintain said bottom-hole treating pressure approximately constant, but above said fracture closure pressure and below said fracture extension pressure;

d) monitoring said injection rate during the step disclosed in paragraph (c);

e) continuing said step of gradual reduction in said injection rate until a period of approximately constant bottom-hole treating pressure has been achieved;

f) determining at least one parameter needed for a fracture treatment design from said injection rate during said step of gradual reduction in said injection rate;

g) using said parameter to solve for the product of the fluid-loss coefficient and square of fracture radius; and h) using said product of fluid-loss coefficient and square of fracture radius to determine parameters of said full-scale fracture treatment.

10. A method of determining parameters of a full scale fracture treatment of a subterranean formation comprising the steps of:

a) injecting fluid that will be used in said full scale fracture treatment into said subterranean formation through a wellbore at a generally constant rate or a lineraly increasing rate sufficient to create a fracture;

b) decreasing said injection rate, after a fracture of substantial radius has been created, such that the bottom-hole treating pressure is below a predetermined fracture extension pressure and above a predetermined fracture closure pressure;

c) gradually reducing said injection rate so as to maintain said bottom-hole treating pressure approximately constant, but above said fracture closure pressure and below said fracture extension pressure;

d) monitoring said injection rate during the step disclosed in paragraph (c);

e) continuing said step of gradual reduction in injection rate until a period of approximately constant bottom-hole treating pressure has been achieved;

f) plotting log of said injection rate versus log of dimensionless time;

g) determining the fluid-loss exponent;

h) determining the fracture growth exponent;

i) calculating the product of the fluid-loss coefficient and the square of fracture radius at the end of said period of constant variation injection rate; and j) using said product to design said full scale fracture treatment.

11. The method of claim 10 further comprising a step, performed after said period of approximately constant bottom-hole treating pressure is achieved, of shutting-in the wellbore and performing a pump-in, shut-in analysis.

12. The method of claim 10 further comprising a step, performed after said period of approximately constant bottom-hole treating pressure is achieved, of flowing-back the injected fluid through the wellbore and performing a pump-in, flow-back analysis.

13. The method of claim 9 wherein said initial fluid injection is at a generally constant rate.

14. The method of claim 10 wherein said initial fluid injection is at a generally constant rate.

* * * * *